US006387584B1

(12) United States Patent
Ikeda et al.

(10) Patent No.: US 6,387,584 B1
(45) Date of Patent: May 14, 2002

(54) PHOTOIMAGING MATERIAL

(75) Inventors: Kensuke Ikeda; Makoto Ono, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 08/764,397

(22) Filed: Dec. 11, 1996

(30) Foreign Application Priority Data

Feb. 14, 1996 (JP) ..... 8-026482

(51) Int. Cl.[7] ..... G03C 1/675

(52) U.S. Cl. ..... 430/138; 430/336; 430/337; 430/351; 430/348; 430/350; 503/219; 503/225; 503/216; 503/226

(58) Field of Search ..... 503/219, 225, 503/216, 226; 430/138, 336, 337, 350, 351, 348

(56) References Cited

U.S. PATENT DOCUMENTS

| | | | | | |
|---|---|---|---|---|---|
| 3,937,864 | A | * | 2/1976 | Kohmura et al. | 427/151 |
| 4,247,618 | A | * | 1/1981 | Dessauer et al. | 430/338 |
| 4,425,161 | A | * | 1/1984 | Shibahashi et al. | 427/148 |
| 4,962,009 | A | * | 10/1990 | Washizu et al. | 430/138 |
| 4,981,769 | A | * | 1/1991 | Saeki et al. | 430/138 |
| 5,035,974 | A | * | 7/1991 | Saeki et al. | 430/138 |
| 5,055,373 | A | * | 10/1991 | Saeki et al. | 430/138 |

FOREIGN PATENT DOCUMENTS

| | | | |
|---|---|---|---|
| JP | 62-39728 | 8/1987 | G03C/1/727 |
| JP | 6239728 | 8/1987 | |
| JP | A244 | 1/1990 | |
| JP | 2-44 | 1/1990 | G03C/1/675 |
| JP | 3191341 | 8/1991 | |
| JP | 3-191341 | 8/1991 | G03C/1/675 |

* cited by examiner

*Primary Examiner*—Martin Angebranndt
(74) *Attorney, Agent, or Firm*—Sughrue Mion, PLLC

(57) ABSTRACT

A photoimaging material which comprises a support and a photoimaging layer formed on the support. The photoimaging layer comprises microcapsules and a reducing agent present outside the microcapsules. The microcapsules contain a leuco dye capable of oxidative color formation, a photooxidizing agent and an organosulfur antioxidant. The reducing agent is 2,2'-methylenebis(4-methyl-6-t-butylphenol) or 2,2'-methylenebis(4-ethyl-6-t-butylphenol). The photoimaging material is capable of thermal image fixing based on a method of forming color by radical oxidation of various leuco dyes to the corresponding dyes with a photooxidizing agent. The photoimaging material is not prone to background coloring (fogging) during storage under dark or light conditions after image fixing, and does not foul the inside of the apparatus during thermal image fixing.

12 Claims, No Drawings

PHOTOIMAGING MATERIAL

FIELD OF THE INVENTION

The present invention relates to a photoimaging material containing a leuco dye which is capable of thermal image fixing. More particularly, the present invention relates to a photoimaging material which is not susceptible to background coloring (fogging) upon storage in dark or light environments after thermal image fixing. The photoimaging material of the invention can be used as a proof paper, a print-out paper, an overlay film, etc.

BACKGROUND OF THE INVENTION

Photoimaging materials which can be used as a proof paper, a print-out paper, an overlay film, and the like have hitherto been employed in various photographic applications. The image-wise exposed areas become visible in such as so-called free-radical photographic materials. Especially useful among these techniques are a method of forming color by radical oxidation of various leuco dyes to the corresponding dyes with a photooxidizing agent.

However, because of sensitivity to light, the above techniques are disadvantageous in that the dye image of a photoimaging material formed by exposure is prone to color formation upon further exposure to ordinary room light, sunlight, or white light or even upon storage in the dark. Several techniques for fixing the image after image-wise exposure have been proposed. Among these is a photoimaging material which comprises microcapsules containing both a leuco dye and a photooxidizing agent as encapsulated ingredients, and which further comprises a reducing agent arranged the outside of the microcapsules. In this photoimaging material, the image is fixed by heating after exposure (see JP-A-2-44). (The term "JP-A" as used herein means an "unexamined published Japanese patent application.")

Hydroquinone reducing agents are known to improve the storage stability of the above-described photoimaging recording material after image fixing (see JP-A-3-191341). However, these hydroquinone reducing agents are disadvantageous in that after image fixing they tend to cause background coloring (fogging) during storage under light or dark conditions. As a result, the recording material has reduced contrast between the image areas and the background (white areas) to thereby impair quality. Thus, a fully satisfactory photoimaging material has not been obtained with the above technique.

The hydroquinone reducing agents mentioned above and the reducing agents described in JP-B-62-39728, including cyclic phenylhydrazide compounds, guanidine derivatives, alkylenediamine derivatives, hydroxyamine derivatives and phenylhydrazine compounds, further have another problem in that the reducing agents tend to vaporize or sublimate during thermal fixing or the molten reducing agent becomes oily and accumulates to foul the thermal fixing apparatus. (The term "JP-B" as used herein means an "examined Japanese patent publication.")

SUMMARY OF THE INVENTION

An object of the present invention is to provide a photoimaging material capable of thermal image fixing and which is based on a method of forming color by radical oxidation of various leuco dyes to the corresponding dyes with a photooxidizing agent, which photoimaging material is not prone to background coloring (fogging) during storage under dark or light conditions after image fixing and which does not foul the inside of the apparatus during thermal image fixing.

The above object of the present invention is accomplished by providing a photoimaging material comprising a support having thereon a photoimaging layer comprising microcapsules and a reducing agent present outside the microcapsules, wherein the microcapsules contain a leuco dye capable of oxidative color formation, a photooxidizing agent, and an organosulfur antioxidant, and the reducing agent is 2,2'-methylenebis(4-methyl-6-t-butylphenol) or 2,2'-methylenebis(4-ethyl-6-t-butylphenol).

DETAILED DESCRIPTION OF THE INVENTION

The present invention is described in further detail below.

The reducing agent for use in the present invention is 2,2'-methylenebis(4-methyl-6-t-butylphenol) or 2,2'-methylenebis(4-ethyl-6-t-butylphenol). These compounds hitherto have not been used as fixing agents, because their ability to trap free radicals is inferior to that of other known reducing agents. Also, these compounds tend to cause background coloring (fogging) during storage in light or dark conditions when used as a fixing agent in an imaging material comprising a leuco dye and a photooxidizing agent. However, those two compounds are less prone to vaporize upon heating, and there is little fouling of the inside of the thermal fixing apparatus because the melts thereof do not change to an oily, sticky state but rather recrystallize.

Hence, the present inventors sought to develop a technique for improving fixing performance while maintaining reduced apparatus fouling. As a result, the present inventors discovered that by encapsulating an organosulfur antioxidant in microcapsules, background coloring (fogging) during storage in light or dark conditions after fixing can be prevented even when 2,2'-methylenebis(4-methyl-6-t-butylphenol) or 2,2'-methylenebis(4-ethyl-6-t-butylphenol) is used as a reducing agent. The present invention has been achieved based on this finding.

The organosulfur antioxidant for use in the present invention may be a known secondary antioxidant organosulfur compound for use in the field of polyolefins, styrene resins, and the like.

Examples of the antioxidant include dilauryl 3,3'-thiodipropionate, dimyristyl 3,3'-thiodipropionate, distearyl 3,3'-thiodipropionate, ditridecyl 3,3'-thiodipropionate and pentaerythrityl tetrakis(3-laurylthiopropionate). However, the organosulfur antioxidant for use in the present invention is not limited to these examples. The addition amount of the antioxidant is preferably from 0.01 to 2 mol, more preferably from 0.05 to 1 mol, per mol of the reducing agent .

Preferred examples of the leuco dye for use in the present invention include the following leuco dyes which are described in U.S. Pat. No. 3,445,234:

(A) aminotriarylmethanes, aminoxanthene, aminooxanthene, amino-9,10-dihydroacridine, aminophenoxazine, aminophenothiazine, aminodihydrophenazine, aminodiphenylmethane, and leucoindamine; and (B) aminohydrocinnamic acid (cyanoethane), hydrazine, leucoindigoid dyes, amino-2,3-dihydroanthraquinone, tetrahalo-p,p-biphenols, 2-(p-hydroxyphenyl)-4,5-diphenylimidazole and phenethylaniline.

Of the leuco compounds enumerated above, those belonging to group (A) each loses one hydrogen atom to form a corresponding colored dye, while those belonging to group (B) each loses two hydrogen atoms to form a corresponding colored dye.

Specific examples of the leuco dye include tris(4-dimethylaminophenyl)methane, tris(4-diethylaminophenyl)-methane, tris(4-diethylamino-2-methylphenyl)methane, bis(4-diethylaminophenyl)(4-diethylamino-2-methylphenyl)methane, bis(4-diethylamino-2-methylphenyl)(4-diethylaminophenyl)-methane, bis(1-ethyl-2-methylindol-3-yl)phenylmethane, 2-N-(3-trifluoromethylphenyl)-N-ethylamino-6-diethylamino-9-(2-methoxycarbonylphenyl)xanthene, 2-(2-chlorophenyl)amino-6-dibutylamino-9-(2-methoxycarbonylphenyl)xanthene, 2-dibenzylamino-6-diethylamino-9-(2-methoxycarbonylphenyl)-xanthene, benzo[a]-6-N,N-diethylamino-9-(2-methoxycarbonyl-phenyl)xanthene, 2-(2-chlorophenyl)-amino-6-dibutylamino-9-(2-methylphenylcarboxamidophenyl) xanthene, 3,6-dimethoxy-9-(2-methoxycarbonyl) phenylxanthene, benzoyl leucomethylene blue and 3,7-bisdiethylaminophenoxazine.

The photooxidizing agent for use in the photoimaging material of the present invention preferably is a compound which is inert in its ordinary state. However, upon exposure to actinic radiation such as visible rays, ultraviolet rays, infrared rays, or X-rays, the photooxidizing agent generates a chemical species which oxidizes the leuco dye to a corresponding colored dye.

Representative examples of the photooxidizing agent include the lophine dimer compounds described in JP-B-62-39728 and JP-B-63-2099, such as 2,2'-bis(o-chlorophenyl)-4,4',5,5'-tetraphenylbiimidazole, 2,2'-bis(o-trifluoromethylphenyl)-4,4,',5,5'-tetraphenylbiimidazole, 2,2'-bis(o-trifluoromethylphenyl)-4,4',5,5'-tetrakis(4-methoxyphenyl)imidazole, 2,2'-bis(o-trifluoromethylphenyl)-4,4',5,5'-tetrakis(3,4-methylenedioxyphenyl)imidazole, 2,2'-bis(o-nitrophenyl)-4,4',5,5'-tetraphenylbiimidazole, 2,2'-bis(2,3-dichlorophenyl)-4,4',5,5'-tetraphenylbiimidazole, 2,2'-bis(2,3-dichlorophenyl)-4,4',5,5'-tetrakis(3-methoxyphenyl) imidazole and 2,2',5-tris(o-chlorophenyl)-4-(3,4-dimethoxyphenyl)-4',5'-diphenylbiimidazole; the azide compounds described in U.S. Pat. No. 3,282,693, such as 2-azidobenzoxazole, benzoyl azide and 2-azidobenzimidazole; the pyridinium compounds described in U.S. Pat. No. 3,615,568, such as 3'-ethyl-1-methoxy-2-pyridothiacyanin perchlorate and 1-methoxy-2-methylpyridinium p-toluenesulfonate; organohalogen compounds such as N-bromosuccinimide, tribromomethyl phenyl sulfone, 2-trichloromethyl-5-(p-butoxystyryl)-1,3,4-oxadiazole and 2,6-ditrichloromethyl-4-(p-methoxyphenyl)-triazine; and the azide polymers described in 1968-nen Shunki Kenkyū Happyōkai Kōenyōshi (Spring Meeting of the Photographic Science and Technology Society of Japan, Abstract Papers), p. 55 (1968). Of these photooxidizing agents, the lophine dimer compounds and the organohalogen compounds are preferred. The most desirable is a combination of a lophine dimer compound and an organohalogen compound because such a combination provides higher sensitivity.

In producing the photoimaging material of the present invention, a leuco dye and a photooxidizing agent are mixed in a molar ratio of preferably from 10:1 to 1:10, more preferably from 2:1 to 1:2.

Preferred microcapsules for use in the present invention function in such a manner that the capsule walls insulate the encapsulated substances from external substances (i.e, substances arranged outside the microcapsules) at ordinary temperatures and show enhanced permeability only when heated to a given temperature or higher. The permeation initiation temperature can be controlled as needed by suitably selecting the material of the capsule walls, the material of the capsule cores and additives. The permeation initiation temperature in this case is the glass transition temperature of the capsule walls.

The kind of capsule wall material is suitably selected for controlling the glass transition temperature of the capsule walls. Examples of useful wall materials include polyurethanes, polyureas, polyamides, polyesters and polycarbonates. Of these, polyurethanes and polyureas are especially preferred.

Microcapsules for use in the present invention are produced by emulsifying core substances containing photoimaging substances including a leuco dye and a photooxidizing agent, and then forming a wall of a polymeric substance around each of the emulsified droplets. In this case, the reactants which form the walls are added to the inside and/or the outside of the droplets.

A high-boiling oil is used as a n organic solvent for dissolving the photoimaging substances therein. Examples thereof include phosphoric esters, phthalic esters, acrylic esters, methacrylic esters, other carboxylic esters, fatty acid amides, alkylated biphenyls, alkylated terphenyls, alkylated naphthalenes, diarylethanes and chlorinated paraffins. In the present invention, a low-boiling point auxiliary solvent may be added to the organic solvent. Examples of the auxiliary solvent include ethyl acetate, isopropyl acetate, butyl acetate, methylene chloride and cyclohexanone.

For stabilizing the emulsified droplets, a protective colloid or a surfactant can be added to the aqueous phase. A water-soluble polymer such as poly(vinyl alcohol) or gelatin is generally useful as the protective colloid.

The size of the microcapsules for use in the present invention is preferably 10 $\mu$m or smaller, more preferably 4 $\mu$m or smaller, in terms of volume-average size especially in view of improving image resolution and handleability. The lower limit thereof is about 0.2 $\mu$m.

An antioxidant other than an organosulfur antioxidant may be incorporated into the microcapsules in order to enhance the stability of the photoimaging material before use. Preferred examples of this additional antioxidant include phenol compounds, hydroquinone compounds, catechol compounds and aniline compounds. Specific examples thereof include 2,6-di-t-butyl-4-methylphenol, 2,4,6-tri-t-butylphenol, 2,5-di-t-butylhydroquinone, 2,3-di-t-butylhydroquinone, 2,5-di-t-octylhydroquinone, 2,3-di-t-butylhydroquinone, 2,5-di-t-octylhydroquinone, 2,5-di-t-amylhydroquinone, 3,6-di-t-butylcatechol, N,N-dioctylaniline, N,N-dimethyl-p-toluidine, N,N-dibutyl-m-toluidine, N,N-diethyl-m-phenetidine, N,N-diethylamino-m-octyloxybenzene, 6-ethoxy-1,2,3,4-tetrahydro-2,2,4-trimethylquinoline, 1,2-bis(m-dimethylaminophenoxy) ethane, 1,2-bis(m-diethylaminophenoxy)ethane and 1,3-bis (m-diethylaminophenoxy)propane.

In producing the photoimaging material of the present invention, an antioxidant other than an organosulfur antioxidant may be added preferably in a molar ratio of the photooxidizing agent to the antioxidant of from 10:0.001 to 10:2, more preferably from 10:0.01 to 10:1.

A compound which is a solid at ordinary temperatures and selected from compounds which plasticize the capsule wall material (polymer) may be used as an accelerator for thermal fixing. For example, phenol compounds, bisphenol compounds, gallic acid compounds, organic sulfonamide compounds, arylamide compounds, and the like may be suitably used. Specific examples thereof include 2,2-bis(4-hydroxyphenyl)-propane, 4,4'-[1,4-phenylenebis(1-methylethylidene)]bis-phenol, p-toluenesulfonamide and lauryl gallate.

In the present invention, the reducing agent or the fixing accelerator is preferably used in the form of a dispersion prepared by dispersing the solid reducing agent or fixing accelerator with, e.g., a sand mill using a water-soluble polymer as a protective colloid, or in the form of an emulsion dispersion. The emulsion dispersion is prepared by dissolving the reducing agent or fixing accelerator into an organic solvent which is insoluble or sparingly soluble in water, and then dispersing the solution into an aqueous phase containing a surfactant and a water-soluble polymer as a protective colloid.

The addition amount of the reducing agent in the present invention is preferably from 1 to 100 mol, more preferably from 1 to 10 mol, per mol of the photooxidizing agent.

The addition amount by weight of the fixing accelerator for use in the present invention is preferably from 0.05 to 10 times, more preferably from 0.1 to 5 times, the weight of the reducing agent.

The photoimaging material of the present invention can be produced by coating a support with a dispersion which contains the above-described microcapsules having encapsulated therein a leuco dye, a photooxidizing agent and an organosulfur antioxidant, and which further contains a reducing agent arranged outside the microcapsules as described above. The dispersion may further contain additives such as a binder, a pigment, a wax, a metal soap, fixing accelerator dispersion and a surfactant.

The photoimaging layer in the present invention is coated on a support preferably in an amount of from 1 to 30 g/m$^2$, more preferably from 2 to 10 g/M$^2$, on a solid basis.

Useful support materials include papers such as wood-free paper, synthetic papers, papers laminated with polyethylene or the like, regenerated cellulose, cellulose acetate, cellulose nitrate, poly(ethylene terephthalate), polyethylene, poly(vinyl acetate), poly(methyl methacrylate), poly(vinyl chloride), polycarbonates, and the like.

Methods for coating the support include air-knife coating, curtain coating, slide coating, roller coating, dip coating, wire bar coating, blade coating, gravure coating, spin coating and extrusion coating. However, the coating methods that can be used to form the photoimaging layer are not limited to the above-noted methods.

If desired and necessary, a subbing layer may be formed on the support, or a covering layer may be formed on the photoimaging layer. The subbing layer and the covering layer each contains a binder and/or a pigment as main components(s).

Any convenient light source can be used in the present invention for activating the photooxidizing agent and forming a leuco dye image. Light sources for common use include fluorescent lamps, mercury lamps, metal halide lamps, xenon lamps and tungsten lamps.

The present invention is explained below in more detail by reference to the following Examples, but the invention should not be construed as being limited thereto. Hereinafter, all parts indicating addition amounts are given by weight.

EXAMPLE 1

In a mixed solvent consisting of 54 parts of ethyl acetate and 34 parts of trixylenyl phosphate were dissolved 1 part of tris(4-dimethylaminophenyl)methane, 2.3 parts of tris(4-diethylamino-2-methylphenyl)methane, 6.7 parts of 2,2'-bis(o-chlorophenyl)-4,4',5,5'-tetraphenylbiimidazole, 1.3 parts of tribromomethyl phenyl sulfone, 0.6 parts of 2,5-di-t-octylhydroquinone, 16.1 parts of ditridecyl 3,3'-thiodipropionate, and 33 parts of a 75 wt % ethyl acetate solution of a xylylene diisocyanate/trimethylolpropane adduct. This solution was added to 270 parts of a 4 wt % aqueous solution of a carboxylated poly(vinyl alcohol), and emulsified and dispersed therein at 20° C. to obtain an emulsion having a volume-average particle diameter of 1.3 μm. Water in an amount of 88 parts was added to the emulsion. The resulting mixture was continuously stirred at 50° C. for 3 hours. This mixture was cooled to room temperature and then filtered to obtain a capsule dispersion. The solid concentration of this capsule dispersion was measured, and was found to be 25% by weight.

Subsequently, 10 parts of 2,2'-methylenebis(4-ethyl-6-t-butylphenol) and 21 parts of 2,2-bis(4-hydroxyphenyl) propane were added to an aqueous solution prepared by mixing 17 parts of 2 wt % aqueous solution of sodium di(2-ethylhexyl)sulfosuccinate, 47 parts of a 10 wt % aqueous solution of a carboxylated poly(vinyl alcohol), and 49 parts of water. After stirring, the resulting mixture was treated with a horizontal sand mill (Dynomill, manufactured by Web Corp.) to obtain a reducing agent dispersion having a volume-average particle diameter of 1.3 μm. The solid concentration of this dispersion was measured, and was found to be 25% by weight.

A coating solution having the following composition was then prepared.

| | |
|---|---|
| Capsule dispersion described above (25 wt %) | 100 parts |
| Reducing agent dispersion described above (25 wt %) | 89 parts |
| 20% silica dispersion (Syloid 404, manufactured by Fuji-Davision Chemical, Ltd., Japan) | 6 parts |
| 10% aqueous solution of poly(vinyl alcohol) (PVA-117, manufactured by Kuraray Co., Ltd., Japan) | 20 parts |
| 10% aqueous 4-methylpentyl sulfosuccinate solution | 2 parts |

The coating solution was applied to wood-free paper (basis weight, 76 g/m$^2$) by free-falling curtain coating in an amount of 6 g/m$^2$ on a solid basis, and the coating was dried while regulating the temperature of the coating surface so as not to exceed 60° C. Thus, a photoimaging material was obtained.

EXAMPLE 2

A photoimaging material was obtained in the same manner as in Example 1, except that 2,2'-methylenebis(4-methyl-6-t-butylphenol) was used in place of 10 parts of 2,2'-methylenebis(4-ethyl-6-t-butylphenol).

EXAMPLE 3

A photoimaging material was obtained in the same manner as in Example 1, except that 15.3 parts of dilauryl 3,3'-thiodipropionate was used in place of 16.1 parts of ditridecyl 3,3'-thiodipropionate.

COMPARATIVE EXAMPLE 1

A photoimaging material was obtained in the same manner as in Example 1, except that 16.1 parts of ditridecyl 3,3'-thiodipropionate was not used.

COMPARATIVE EXAMPLE 2

To 65 parts of a 6 wt % aqueous solution of a carboxylated poly(vinyl alcohol) were added 10 parts of 2,5-di-t-octylhydroquinone and 16 parts of 2,2-bis(4-hydroxyphenyl)propane. The resulting mixture was treated with a horizontal sand mill to obtain a reducing agent dispersion having a volume-average particle diameter of 1.0 μm.

A coating solution having the following composition was then prepared.

| | |
|---|---|
| Capsule dispersion prepared in Example 1 (25 wt %) | 100 parts |
| Reducing agent dispersion described above | 75 parts |
| 20% silica dispersion (Syloid 404, manufactured by Fuji-Davision Chemical, Ltd.) | 6 parts |
| 10% aqueous solution of poly(vinyl alcohol) (PVA-117, manufactured by Kuraray Co., Ltd.) | 20 parts |
| 10% aqueous 4-methylpentyl sulfosuccinate solution | 2 parts |

The coating solution was applied to wood-free paper (basis weight, 76 g/m$^2$) by free-falling curtain coating in an amount of 6 g/m$^2$ on a solid basis, and the coating was dried while regulating the temperature of the coating surface so as not to exceed 60° C. Thus, a photoimaging material was obtained.

COMPARATIVE EXAMPLE 3

To 23 parts of a 6 wt % aqueous solution of a carboxylated poly(vinyl alcohol) were added 9.4 parts of 1-phenylpyrazolin-3-one (phenidone A) and 0.9 parts of p-toluenesulfonamide. The resulting mixture was treated with a horizontal sand mill to obtain a reducing agent dispersion having a volume-average particle diameter of 1.0 μm.

A coating solution having the following composition was then prepared.

| | |
|---|---|
| Capsule dispersion prepared in Comparative Example 1 (25 wt %) | 100 parts |
| Reducing agent dispersion described above | 75 parts |
| 20% silica dispersion (Syloid 404, manufactured by Fuji-Davision Chemical, Ltd.) | 6 parts |
| 10% aqueous solution of poly(vinyl alcohol) (PVA-117, manufactured by Kuraray Co., Ltd.) | 20 parts |
| 10% aqueous 4-methylpentyl sulfosuccinate solution | 2 parts |

The coating solution was applied to wood-free paper (basis weight, 76 g/m$^2$) by free-falling curtain coating in an amount of 6 g/m$^2$ on a solid basis, and the coating was dried while regulating the temperature of the coating surface so as not to exceed 60° C. Thus, a photoimaging material was obtained.

The photoimaging materials obtained in Examples 1 to 3 and Comparative Examples 1 to 3 were evaluated by the following tests. The results obtained are shown in Table 1.

(1) Image Density, Background Density just after Fixing

A sample just after coating was exposed to light using a Jet Light (extra-high pressure mercury lamp, manufactured by ORC Manufacturing Co., Ltd.) through an original bearing a line drawing to obtain a blue image. The sample was then passed through 130° C. heating rollers at a speed of 450 mm/min to conduct fixing in the unexposed areas (using a CA-1200, manufactured by Fuji Photo Film Co., Ltd.). After fixing, the color density of the exposed areas and that of the unexposed areas was measured with a Macbeth densitometer.

(2) Fixing Property

The image part of the sample produced by method (1) described above was irradiated with light for 8 hours using an ordinary fluorescent tube (room illumination, 800 lux). The color density of the unexposed background was then measured with a Macbeth densitometer. The unexposed areas (white background) desirably have a color density of 0.12 or lower so as not to impair commercial value.

(3) Storage Stability

The sample produced by method (1) described above was stored in the dark at 30° C. for 1 month or for 3 months. The color density of the unexposed areas (white background) was then measured with a Macbeth densitometer. The value thus obtained was compared with the background color density measured prior to storage and just after fixing. A background color density after storage in the dark that is higher than the color density of the unexposed areas just after fixing indicates that the sample (unexposed areas) has poor storage stability in the dark.

(4) Apparatus Fouling

Three thousand A0-size sample sheets were passed through 130° C. heating rollers at a speed of 450 mm/min to conduct fixing in the unexposed areas (using a CA-1200, manufactured by Fuji Photo Film Co., Ltd.). After completing the test, the heating rollers and the surrounding parts including the heating roller cover, which is essential for safety, were visually examined for fouling.

TABLE 1

| | Test (1) | | Test (2) | Test (3) | |
|---|---|---|---|---|---|
| | Image density | Background density | Background density | After 1 month | After 3 months |
| Ex. 1 | 0.86 | 0.04 | 0.06 | 0.07 | 0.07 |
| Ex. 2 | 0.85 | 0.04 | 0.05 | 0.06 | 0.06 |
| Ex. 3 | 0.86 | 0.04 | 0.06 | 0.08 | 0.08 |
| Comp. Ex. 1 | 0.86 | 0.04 | 0.24 | 0.35 | 0.45 |
| Comp. Ex. 2 | 0.85 | 0.04 | 0.05 | 0.06 | 0.10 |
| Comp. Ex. 3 | 0.85 | 0.04 | 0.05 | 0.06 | 0.06 |

| | Test (4) | |
|---|---|---|
| | Around heating rollers | Heating roller cover |
| Ex. 1 | ○ (almost none) | ○ (almost none) |
| Ex. 2 | ○ (almost none) | ○ (almost none) |
| Ex. 3 | ○ (almost none) | ○ (almost none) |
| Comp. Ex. 1 | ○ (almost none) | ○ (almost none) |
| Comp. Ex. 2 | Δ (considerable crystalline fouling) | Δ (considerable crystalline fouling) |
| Comp. Ex. 3 | x (considerable oily fouling) | x (considerable oily fouling) |

A photoimaging material which retains the basic performance required of a photoimaging material, such as the properties (1) to (3) mentioned above, and which exhibits extremely reduced fouling (4) of a thermal fixing apparatus (i.e., an important quality for practical use), is obtained in accordance with the present invention by using 2,2'-methylenebis(4-methyl-6-t-butylphenol) or 2,2'-methylenebis(4-ethyl-6-t-butylphenol) as a reducing agent, and by encapsulating an organosulfur antioxidant in the microcapsules together with a leuco dye and a photooxidizing agent.

While the invention has been described in detail and with reference to specific embodiments thereof, it will be apparent to one skilled in the art that various changes and modifications can be made therein without departing from the spirit and scope thereof.

What is claimed is:

1. A photoimaging material comprising a support having thereon a photoimaging layer comprising microcapsules and a reducing agent present outside the microcapsules, wherein the microcapsules contain a leuco dye capable of oxidative color formation, a photooxidizing agent and an organosulfur antioxidant, and wherein the reducing agent is 2,2'-methylenebis(4-methyl-6-t-butylphenol) or 2,2'-methylenebis(4-ethyl-6-t-butylphenol).

2. The photoimaging material as claimed in claim 1, wherein the organosulfur antioxidant is selected from the group consisting of dilauryl 3,3'-thiodipropionate, dimyristyl 3,3'-thiodipropionate, distearyl 3,3'-thiodipropionate, ditridecyl 3,3'-thiodipropionate and pentaerythrityl tetrakis (3-laurylthiopropionate).

3. The photoimaging material as claimed in claim 1, wherein the photoimaging layer contains the organosulfur antioxidant in an amount of from 0.01 to 2 moles per mole of the reducing agent.

4. The photoimaging material as claimed in claim 1, wherein the photooxidizing agent is selected from the group consisting of a lophine dimer compound, an azide compound, a pyridinium compound and an organohalogen compound.

5. The photoimaging material as claimed in claim 1, wherein the photooxidizing agent comprises a combination of a lophine dimer compound and an organohalogen compound.

6. The photoimaging material as claimed in claim 1, wherein the microcapsules have a volume-average size of 10 $\mu$m or less.

7. The photoimaging material as claimed in claim 1, wherein the photoimaging layer contains the reducing agent in an amount of from 1 to 100 moles per mole of the photooxidizing agent.

8. The photoimaging material as claimed in claim 1, wherein the photoimaging layer further contains a thermal fixing accelerator.

9. The photoimaging material as claimed in claim 1, wherein the solids content of the photoimaging layer is from 1 to 30 g/m$^2$.

10. The photoimaging material as claimed in claim 1, wherein the reducing agent is 2,2'-methylenebis(4-methyl-6-t-butylphenol).

11. The photoimaging material as claimed in claim 1, wherein the reducing agent is 2,2'-methylenebis(4-ethyl-6-t-butylphenol).

12. The photoimaging material as claimed in claim 1, wherein the photoimaging layer contains the leuco dye and the photooxidizing agent in a molar ratio of from 10:1 to 1:10.

* * * * *